US005919006A

United States Patent [19]

Calandra, Jr. et al.

[11] Patent Number: 5,919,006

[45] Date of Patent: Jul. 6, 1999

[54] TENSIONABLE CABLE BOLT WITH MIXING ASSEMBLY

[75] Inventors: Frank Calandra, Jr., Pittsburgh; John C. Stankus, Canonsburg, both of Pa.; James J. Scott, deceased, late of Rolla, by Deborah Lane Castle, legal representative; Brian R. Castle, Rolla, both of Mo.; John G. Oldsen, Butler, Pa.; Kendal L. Taylor, Masontown, W. Va.; Paul Yacisin, Patton, Pa.

[73] Assignee: Jennmar Corporation, Pittsburgh, Pa.

[21] Appl. No.: 09/019,731

[22] Filed: Feb. 6, 1998

Related U.S. Application Data

[60] Provisional application No. 60/038,187, Feb. 14, 1997, provisional application No. 60/052,567, Jul. 15, 1997, and provisional application No. 60/066,266, Nov. 20, 1997.

[51] Int. Cl.[6] ..... E21D 20/00; E21D 20/02

[52] U.S. Cl. ..... 405/302.2; 405/259.6; 405/259.5

[58] Field of Search ..... 405/259.6, 259.5, 405/259.1, 302.2, 288, 262; 411/2, 3, 5, 8, 9, 14, 62, 72, 82; 57/204

[56] References Cited

U.S. PATENT DOCUMENTS

| | | | |
|---|---|---|---|
| 2,525,198 | 10/1950 | Beijl . | |
| 2,970,444 | 2/1961 | Peter . | |
| 3,077,809 | 2/1963 | Harding et al. . | |
| 3,222,873 | 12/1965 | Williams . | |
| 3,653,217 | 4/1972 | Williams . | |
| 3,942,329 | 3/1976 | Babcock . | |
| 4,100,748 | 7/1978 | Hansen . | |
| 4,194,858 | 3/1980 | Evans | 405/259 |
| 4,265,571 | 5/1981 | Scott | 405/259 |
| 4,440,526 | 4/1984 | Koppers et al. | 405/260 |
| 4,617,715 | 10/1986 | Koistinen et al. | 29/456 |
| 4,655,645 | 4/1987 | Hipkins, Sr. et al. | 405/261 |
| 4,704,053 | 11/1987 | Hipkins, Sr. et al. | 405/261 |
| 4,750,887 | 6/1988 | Simmons | 405/260 |
| 4,790,129 | 12/1988 | Hutchins | 57/204 |
| 5,042,961 | 8/1991 | Scott et al. | 405/261 |
| 5,052,861 | 10/1991 | Hipkins, Sr. | 405/261 |
| 5,078,547 | 1/1992 | Calandra, Jr. et al. | 405/259.5 |
| 5,181,800 | 1/1993 | Stankus et al. | 405/259.6 |
| 5,230,589 | 7/1993 | Gillespie | 405/259.6 |
| 5,244,314 | 9/1993 | Calandra, Jr. et al. | 405/259.4 |
| 5,259,703 | 11/1993 | Gillespie | 405/259.6 |
| 5,288,176 | 2/1994 | Huff et al. | 405/259.6 |
| 5,344,256 | 9/1994 | Hedrick | 405/259.1 |
| 5,375,946 | 12/1994 | Locotos | 405/259.4 |
| 5,378,087 | 1/1995 | Locotos | 405/259.5 |
| 5,511,909 | 4/1996 | Calandra, Jr. et al. | 405/259.6 |
| 5,525,013 | 6/1996 | Seegmiller et al. | 405/259.3 |
| 5,531,545 | 7/1996 | Seegmiller et al. | 405/259.4 |
| 5,556,233 | 9/1996 | Kovago | 405/259.4 |
| 5,586,839 | 12/1996 | Gillespie | 405/259.1 |
| 5,785,463 | 7/1998 | Eaton et al. | 405/302.2 |

FOREIGN PATENT DOCUMENTS

| | | | |
|---|---|---|---|
| 0207522 | 8/1989 | Japan | 405/302.2 |
| 405204 | of 1966 | Switzerland . | |

OTHER PUBLICATIONS

Product Report 102 BLM Mincon Inc. 1–92 "Preformed Cable Anchor" pp. JO1680–83.

Bureau of Mines Information Circular/1994, "Cable Bolt Support Technology in North America" J.M. Goris, S.D. Nickson and R. Pakalnis, pp. 6–11.

*Primary Examiner*—Dennis L. Taylor

*Attorney, Agent, or Firm*—Webb Ziesenheim Bruening Logsdon Orkin & Hanson, P.C.

[57] ABSTRACT

A tensionable mine roof cable bolt having a resin grouted upper portion and a mechanically anchored lower portion. The lower portion includes a shaft which is swaged to the cable and accepts a mechanical anchor. The cable bolt is rotated during installation in a mine roof to mix resin and simultaneously engage the mechanical anchor with the rock. A drivehead attached to the lower end of the cable fails upon tensioning of the bolt to a predetermined load.

18 Claims, 5 Drawing Sheets

TENSIONABLE CABLE BOLT WITH MIXING ASSEMBLY

This application claims the benefits of U.S. Provisional Application Ser. No. 60/038,187 entitled "Tensionable Cable Bolt" filed Feb. 14, 1997, U.S. Provisional Application Ser. No. 60/052,567 entitled "Tensionable Cable Bolt" filed Jul. 15, 1997 and U.S. Provisional Application Ser. No. 60/066,266 entitled "Tensionable Cable Bolt" filed Nov. 20, 1997.

BACKGROUND OF THE INVENTION

1. Field of the Invention

The present invention relates to tensionable cable mine roof bolts, in particular, a tensionable cable mine roof bolt having a tension indicator which is adapted to be grouted and mechanically anchored in a mine roof bore hole.

2. Prior Art

Cable mine roof bolts are gaining popularity in the mining industry for their ease of handling and installation. Cable bolts are substantially easier to fit into a bore hole than the elongated rods of conventional rod bolt systems. Regardless of the height limitations in a mine, cable bolts may be adapted to bore holes of any length due to their flexibility. The strength capacity of cables exceeds that of conventional rod bolts and, therefore, cable is the preferred reinforcement for certain roof conditions.

Conventional cable mine roof bolts are installed by placing a resin cartridge including catalyst and adhesive material into the blind end of a bore hole, inserting the cable bolt into the bore hole so that the upper end of the cable bolt rips open the resin cartridge and the resin flows in the annulus between the bore hole and the cable bolt, rotating the cable bolt to mix the resin catalyst and adhesive and allowing the resin to set about the cable bolt. Typically, the resin is set after two to three minutes. Cable bolts have heretofore been primarily used as secondary roof support structures with tensionable rock bolts serving as the primary anchorage mechanism.

Tensionable cable bolts are the subject of U.S. Pat. No. 5,378,087 to Locotos and U.S. Pat. No. 5,525,013 to Seegmiller et al. Each of the bolts described therein are resin grouted at the blind end of a bore hole and following setting of the resin, they are tensioned by rotation of a nut on an externally threaded sleeve surrounding the free end of the cable. U.S. Pat. No. 5,531,545 to Seegmiller et al. and U.S. Pat. No. 5,556,233 to Kovago both disclose tensionable bolts with a mechanical anchor mounted on the upper end of the cable bolt and tensioning mechanisms disposed on their free ends for post-installation tensioning. Although these prior art cable bolts are tensionable, they require two installation steps; namely, a first step to anchor the upper end of the cable bolt in the bore hole and a second step to tension the bolt.

U.S. Pat. No. 5,375,946 to Locotos discloses a cable bolt having a shaft connected at its upper end, the shaft bearing an expansion anchor. Anchorage of the bolt occurs primarily at the upper end of the bolt by action of the expansion anchor and resin. Thus, anchorage occurs only at the blind end of the bore hole in the vicinity of the expansion anchor and the resin. Another drawback to the bolt is that it is difficult to determine the amount of tension exerted upon the bolt during installation.

It is an object of the present invention to provide a tensionable cable bolt having a plurality of locations of anchorage within a bore hole and which is tensionable to a predetermined load.

SUMMARY OF THE INVENTION

This object is met by the tensionable cable mine roof bolt of the present invention. The cable bolt includes a multi-strand cable having a first end, a second end and a mixing portion positioned between the first and second ends. A barrel and wedge assembly is attached to the cable between the first end and the second end and is adapted to support a bearing plate. A drivehead is attached to the cable first end. An externally threaded shaft surrounds the cable and is attached, preferably by swaging, to the cable between the barrel and wedge assembly and the second end. A mechanical anchor is threaded onto an end of the shaft distal from the barrel and wedge assembly.

The drivehead is press fitted onto the cable first end and is positioned adjacent the barrel and wedge assembly. The drivehead is adapted to break away from the cable when the bolt is tensioned to a predetermined load. A resin compactor is disposed on the cable between the mixing assembly and the mechanical anchor.

The cable includes a central strand and plurality of outer strands wrapped around each other and the central strand. The mixing portion includes one or more sections of the cable wherein a nut is received on the central strand and the outer strands are spaced apart from each other. The mixing portion may further include one or more mixing elements, each having a sleeve member surrounding the cable, the sleeve member including a plurality of baffles mounted on its exterior surface. Alternatively, the mixing portion includes one or more bent sections in the cable. The mixing portion may include one or more mixing wires each fixed at one end thereof to the cable second end and fixed at another end thereof to the cable at a location intermediate the cable first and second ends.

The tensionable cable mine roof bolt as claimed may further include a mechanical anchor delay member surrounding the cable. When the bolt is rotated, the delay member delays a rate at which the mechanical anchor expands to engage a bore hole wall. The delay member may include a spring surrounding the shaft. The spring is adapted to urge the mechanical anchor towards the cable second end. Alternatively, the delay member may include an insert received within an annulus between the mechanical anchor and the cable or include a cap mounted on an end of the mechanical anchor. The cap defines a hole through which the cable extends and is in frictional engagement with the cable.

The present invention further includes a tensionable cable mine roof bolt for insertion into a bore hole in rock and adapted to be resin grouted. The cable bolt includes a bearing plate, a barrel and wedge assembly supporting the bearing plate, a multi-strand cable having a first end and attached to the barrel and wedge assembly and having a resin mixing portion positioned on the cable distal from the first end, a drivehead releasably mounted on a first end of the cable opposite the barrel and wedge assembly from the bearing plate, an externally threaded shaft swaged onto the cable between the bearing plate and the resin mixing assembly, and an expansion anchor threaded onto the shaft. When the bolt is rotated within the bore hole to mix the resin, the expansion anchor engages the rock to permit tensioning of the bolt. The drivehead is press fitted onto the cable and is adapted to break away from the cable when the bolt is tensioned to a predetermined load.

The cable includes a plurality of strands wrapped around each other and the resin mixing portion includes a portion of the cable wherein the strands are spaced apart from each other. Alternatively, the resin mixing portion includes a bend in the cable. The mixing portion further includes a sleeve member surrounding the cable, the sleeve member having a plurality of baffles mounted on an exterior surface of the sleeve member. The mixing portion may further include a pair of sleeve members wherein each of the baffles mounted on each member is adapted to change a direction of resin flowing past the baffles.

A complete understanding of the invention will be obtained from the following description when taken in connection with the accompanying drawing figures wherein like reference characters identify like parts throughout.

DESCRIPTION OF THE PREFERRED EMBODIMENTS

Figure 1:
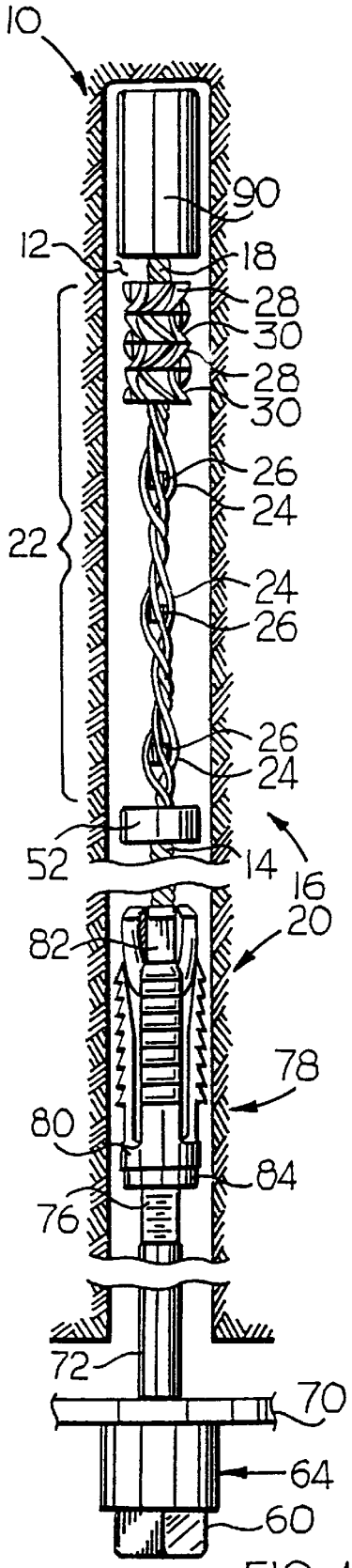
FIG. 1 is a side elevation view of the tensionable cable mine roof bolt, made in accordance with the present invention, illustrating a resin capsule advanced ahead of the cable bolt in a bore hole.

For purposes of the description hereinafter, the terms "upper", "lower", "right", "left", "vertical", "horizontal", "top", "bottom" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

FIG. 1 illustrates a tensionable cable mine roof bolt 10 made in accordance with the present invention. The cable bolt 10 is adapted to be inserted into a drilled bore hole 12 of a rock formation to support the rock formation, such as a mine roof overlaying a mine shaft and the like.

The bolt 10 includes a cable 14 adapted to be received within the bore hole 12. The cable 14 is preferably formed of a galvanized steel strand conforming to ASTM designation A 416 entitled, "Standard Specification for Steel Strand Uncoated Seven Wire for Prestressed Concrete". The cable 14 is generally of a seven-strand type having a central strand enclosed tightly by six helically placed outer strands where the uniform pitch is between twelve and sixteen times the nominal diameter of the cable 14. The cable 14 is generally referred to by grade, with Grade 250 corresponding to an ultimate strength of 250,000 psi and Grade 270 corresponding to an ultimate strength of 270,000 psi.

An upper portion 16 of the cable 14, including an anchored end 18, is adapted to be resin grouted within the bore hole 12 while a lower portion 20 is adapted to be mechanically anchored within the bore hole 12. The upper portion 16 includes a mixing portion 22 for mixing resin within the bore hole 12. The mixing portion 22 may include a plurality of bird cages 24 positioned at spaced locations along the upper portion 16 of the bolt 10. The bird cages 24 are portions of the cable 14 where the strands of the cable 14 have been unwrapped and separated from each other. The central strand may include a washer or a nut 26 within each bird cage 24 which maintains spacing between the central strand and the surrounding strands. The provision of bird cages 24 improves the mixing of the resin during installation as well as increasing the bond strength of the resulting anchorage.

Figure 4:
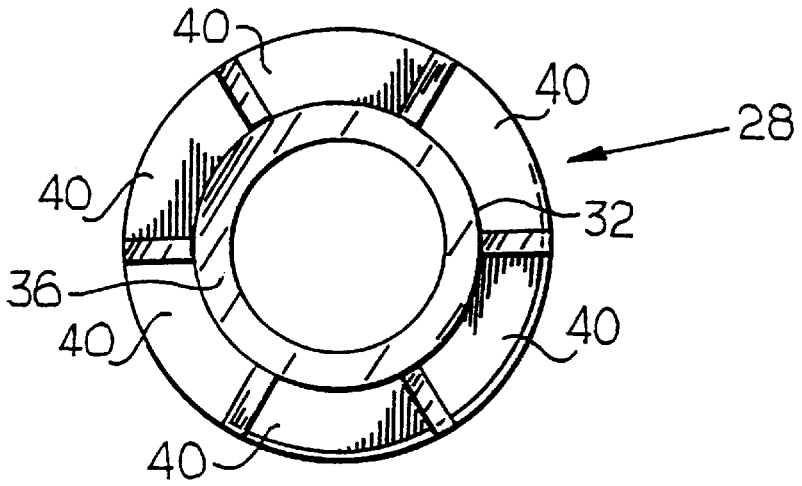
FIG. 4 is an end view of a mixing element depicted on the cable bolt shown in FIGS. 1–3.
Figure 5:
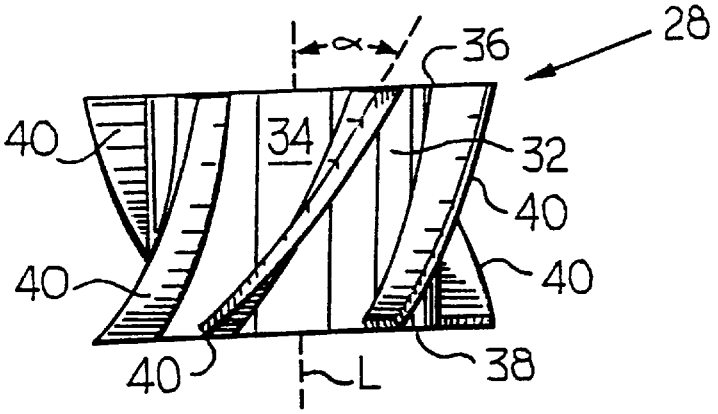
FIG. 5 is a side elevation view of the mixing element shown in FIG. 4.
Figure 6:
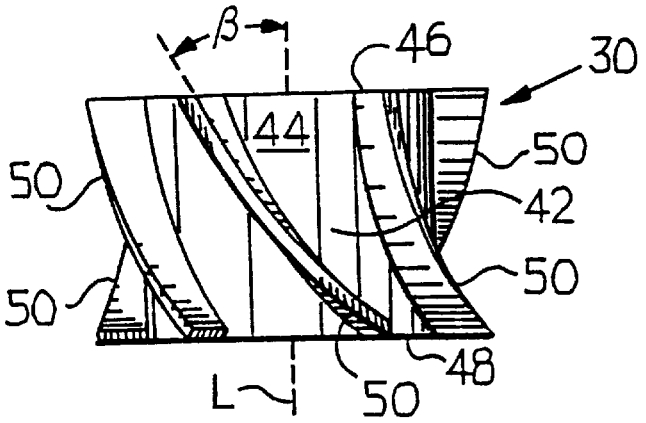
FIG. 6 is a side elevation view of another mixing element depicted on the cable bolt shown in FIGS. 1–3.

The mixing portion 22 may additionally include a plurality of mixing elements 28 and 30 shown in detail in FIGS. 4, 5 and 6. Mixing element 28 includes a sleeve member 32 having an exterior surface 34, two ends 36 and 38 and inner diameter sized to accept the cable 14 but incapable of being readily passed over the bird cages 24. A plurality of radially extending projections or baffles 40 is attached to the exterior surface 34 and extends between the ends 36 and 38 of the sleeve member 32 at an angle a from the longitudinal axis L of the sleeve member 32. The baffles 40 preferably are helically shaped.

As depicted in FIG. 6, mixing element 30 also includes a sleeve member 42 having an exterior surface 44, two ends 46 and 48 and an inner diameter sized to accept the cable 14 but incapable of being readily passed over the bird cages 24. As with the mixing element 28, the mixing element 30 includes a plurality of radially extending projections or baffles 50 attached to the exterior surface 44. The baffles 50 extend between the ends 46 and 48 of the sleeve member 42 at an angle β from the longitudinal axis L and preferably are helically shaped.

Returning to FIG. 1, the mixing elements 28 and 30 are placed on the cable 14 in an alternating fashion. In operation, resin flowing past the mixing elements 28 and 30 will be forced in one direction as it passes the baffles 40 and in another direction as it passes the baffles 50.

Figure 2:
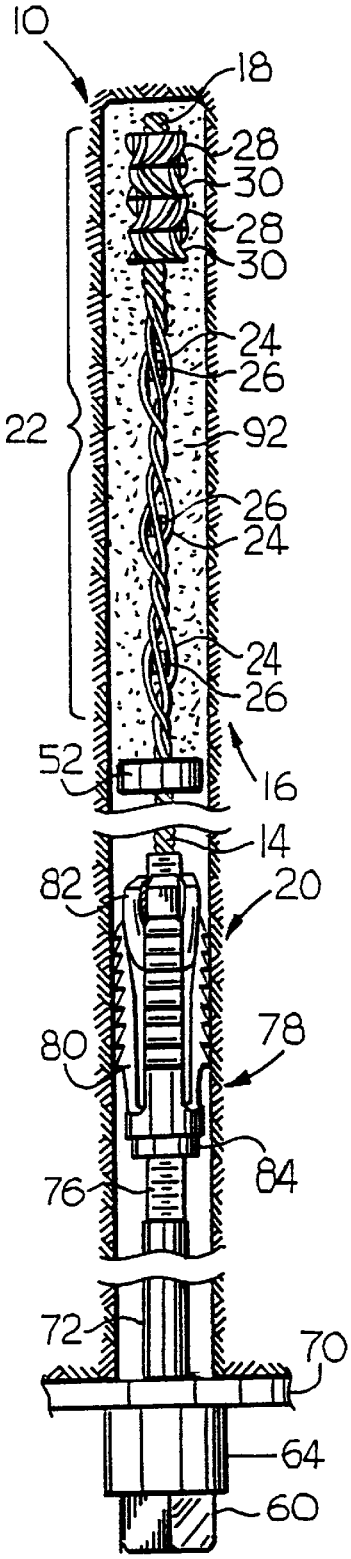
FIG. 2 is another side elevation view of the cable bolt shown in FIG. 1, illustrating rupture of the resin capsule and mixing of the resin components in the bore hole via a drivehead.
Figure 3:
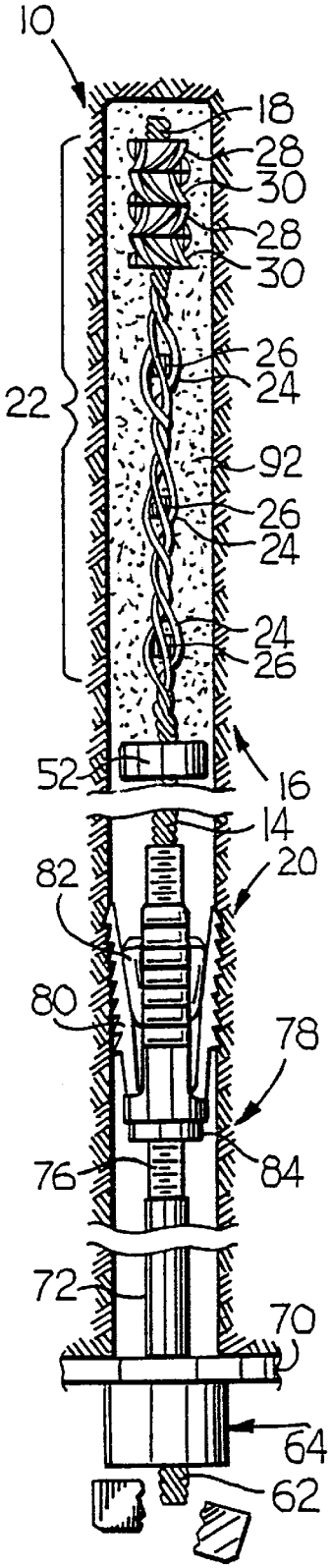
FIG. 3 is another side elevation view of the cable bolt shown in FIG. 1, illustrating failure of the drivehead at a predetermined torque.

A resin compactor 52 is disposed intermediate to the upper portion 16 and the lower portion 20 of the bolt 10. The resin compactor 52 may be cup-shaped as shown in FIGS. 1–3 or include two parts or may include a cylindrical solid member having a central hole as disclosed in U.S. Pat. No. 5,288,176, incorporated herein by reference, or may include a washer and clamp as disclosed in U.S. Pat. No. 5,181,800, incorporated herein by reference.

A separate attached drivehead 60 is mounted onto a first end 62 (FIG. 3) of the cable 14. The drivehead 60 includes an exterior drive surface which preferably has a polygonal cross section, such as a square or hexagon, so that the drivehead 60 can be readily driven by conventional mine roof bolt installing equipment (not shown). A suitable drivehead 60 is one of those disclosed in either of copending applications Ser. No. 08/585,319 filed Jan. 11, 1996 or Ser. No. 08/652,791 filed May 23, 1996 both incorporated herein by reference.

The drivehead 60 is mounted onto the cable 14 with sufficient attachment strength to permit rotation of the bolt 10 with a mine roof bolt installing machine, yet allows the drivehead 60 to break free from the cable 14 upon tensioning of the bolt 10 as described below. Preferably, the drivehead 60 includes a central bore (shown exaggerated in size in FIG. 7) having threads or ridges or other such projections (not shown) and may be press fitted onto the cable 14.

Figure 7:
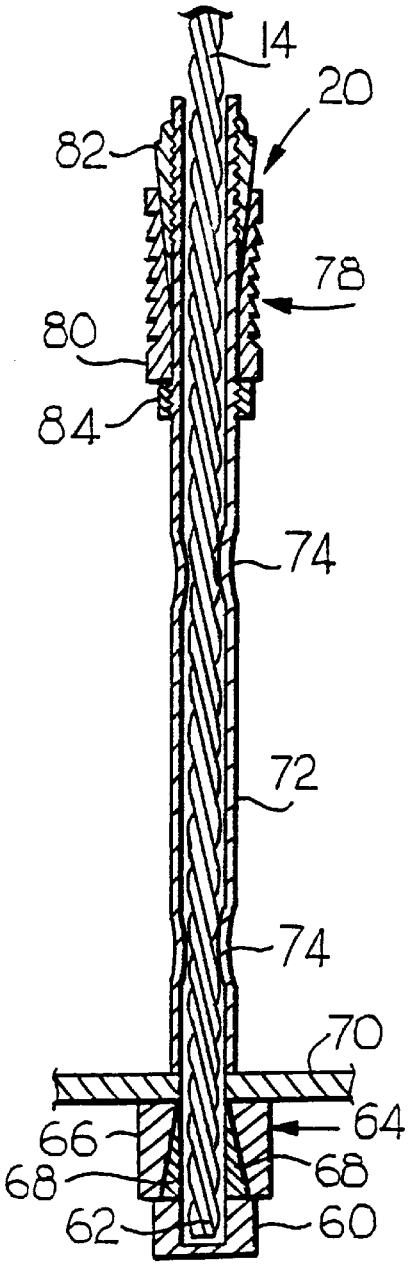
FIG. 7 is a side sectional view of a portion of the cable bolt shown in FIG. 2.

A barrel and wedge assembly 64 is preferably mounted on the cable 14 adjacent the drivehead 60. As depicted in FIG. 7, the barrel and wedge assembly 64 includes a substantially tubular barrel 66 having a tapered internal bore and internal locking wedges 68 having tapered outer surfaces. The locking wedges 68 surround and securely grip onto the cable 14 in a conventional manner. The barrel and wedge assembly 64 is a well-known and accepted mechanism for receiving the loading requirements of a mine roof bolt 10.

In operation, the barrel 66 is adjacent and supports a bearing plate 70. The drivehead 60 is used for rotating the bolt 10 whereas the load of the mine roof is borne by the barrel and wedge assembly 64. To maintain a minimal profile in the confines of a mine chamber, the bolt 10 preferably extends less than about an inch beyond the barrel and wedge assembly 64. This is achieved by abutment of the drivehead 60 against the barrel 66.

The bolt 10 additionally includes a shaft 72 having a central bore adapted to receive the cable 14 on an opposite side of the bearing plate 70 from the drivehead 60. As depicted in FIG. 7, the shaft 72 is crimped or swaged to the cable 14 at a plurality of locations 74 along its length, the degree of crimping or swaging shown exaggerated. The attachment of the shaft 72 to the cable 14 must be sufficiently strong to maintain attachment of the shaft 72 to the cable 14 so that when the cable 14 is rotated, the shaft rotates therewith as a unit. One end of the shaft 72 distal from the barrel and wedge assembly 64 includes external threads 76. The threads 76 are adapted to accept a mechanical anchor 78 having an expansion shell 80, an internally threaded plug 82 and internally threaded stop washer 84. The stop washer 84 is threaded onto the shaft 72 and supports the expansion shell 80 in a conventional manner. Suitable mechanical anchors are disclosed in U.S. Pat. Nos. 5,244,314 and 5,078,547, both incorporated herein by reference.

The outside diameter of the shaft 72 is sized to allow the conventional mechanical anchor 78 to be threaded thereon and to allow the bolt 10 to be inserted into a conventional mine roof bore hole typically 1 ⅜ inches in diameter. Preferably, the nominal outside diameter of the shaft 72 is about ⅞ inch. The inside diameter of the shaft-72 is sized to accept the cable 14.

Returning to FIGS. 1–3, the bolt 10 is inserted into a bore hole 12 with a resin cartridge 90 which ultimately ruptures to form mixed resin 92. The length of the cable bolt 10 is determined by the geologic conditions of the rock formation to be supported. The length of the upper portion 16 of the cable bolt 10 having the mixing portion 22 and the length of the shaft 72 are likewise determined by the geologic conditions of the rock formation to be stabilized and length of the resin cartridge used. In particular, the shaft 72 must be of a sufficient length such that the mechanical anchor 78 mounted thereon will expand upon contact with stable rock. Typically, the cable bolt 10 is about eight to twenty feet long having a shaft 72 of about three feet in length.

Figure 9:
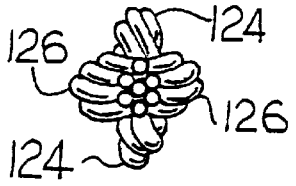
FIG. 9 is a top plan view of the modified tensionable cable mine roof bolt depicted in FIG. 8.
Figure 8:
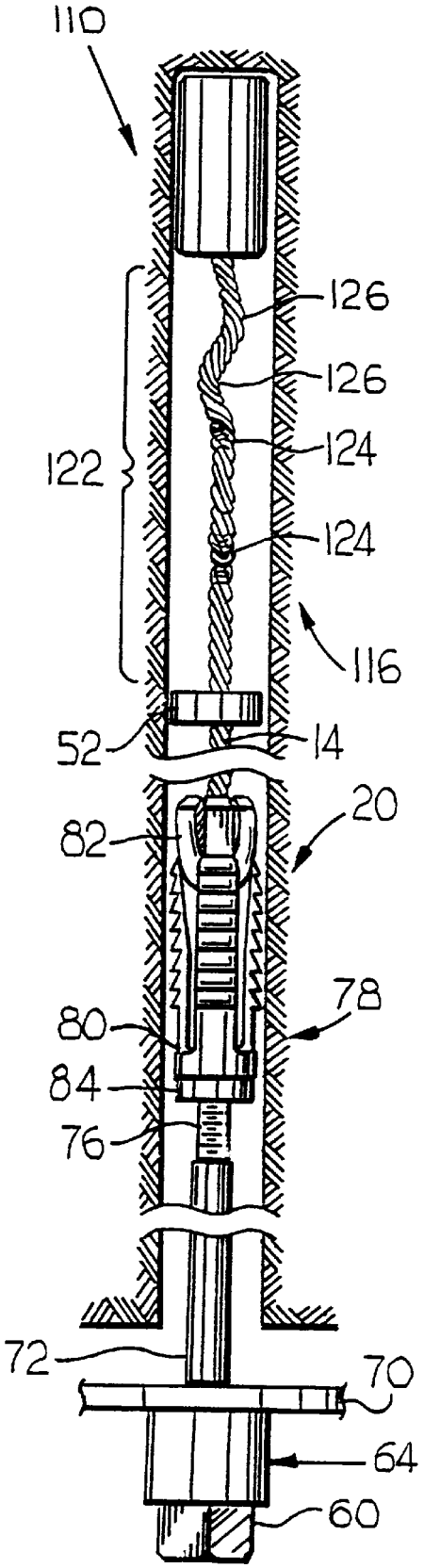
FIG. 8 is a side elevation view of a modified tensionable cable mine roof bolt.

A modified tensionable mine roof cable bolt 110 is shown in FIGS. 8 and 9. The cable bolt 110 includes a lower portion 20 and an upper portion 116. The upper portion 116 of the cable bolt 110 includes a modified mixing portion 122. The modified mixing portion 122 includes crimped or bent portions 124 and 126 of the cable 14. The bent portions 124 and 126 may be in one or more planes. As depicted in FIG. 9 bent portions 124 may be in one plane and bent portions 126 may be in a different plane. Bent portions 124 and 126 are shown in FIGS. 8 and 9 as being in perpendicular planes, but they each may be in any same or different plane with respect to each other. The cable bolt 110 may also include a plurality of mixing elements 28 and 30.

Figure 10:
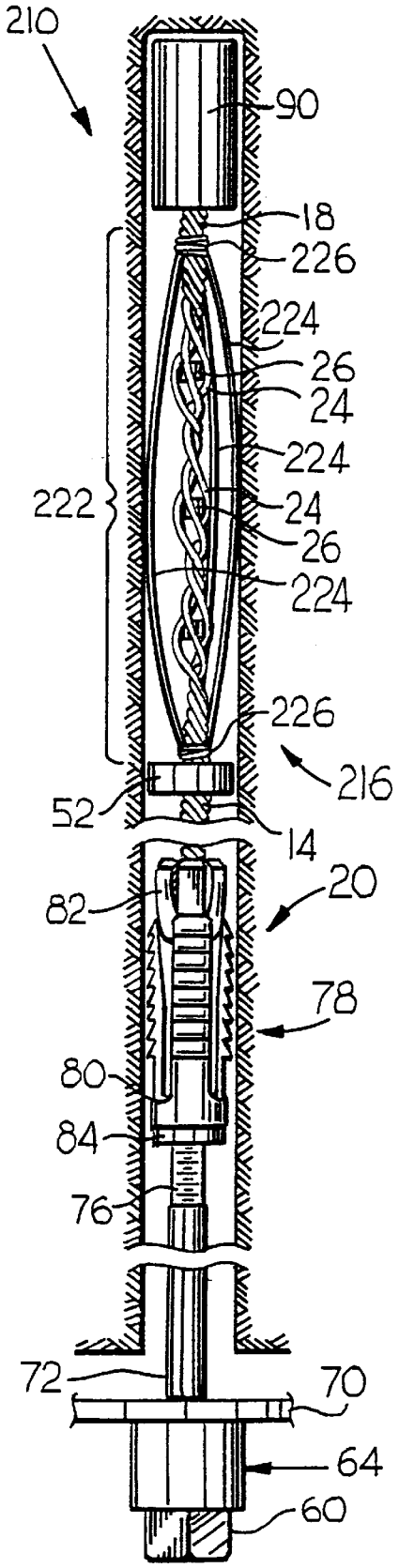
FIG. 10 is a side elevation view of another modified cable mine roof bolt.
Figure 11:
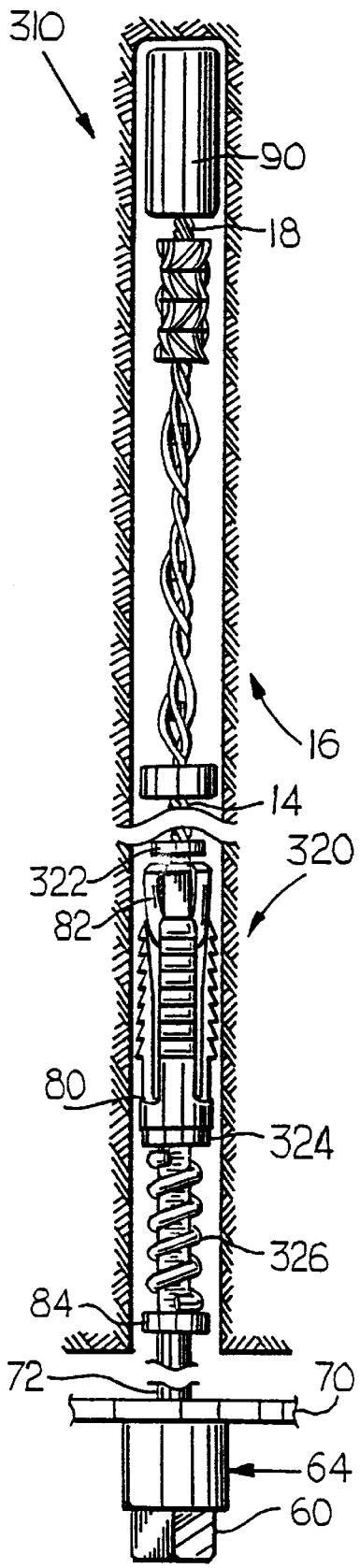
FIG. 11 is a side elevation view of yet another modified cable mine roof bolt.
Figure 12:
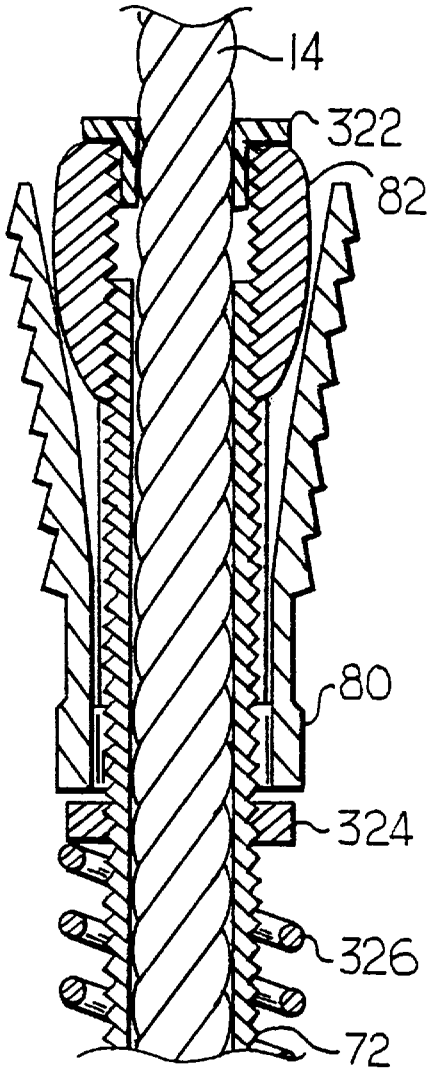
FIG. 12 is a cross section view of a portion of the modified cable mine roof bolt depicted in FIG. 11.

Another modified tensionable mine roof cable bolt 210 is shown in FIG. 10. The cable bolt 210 differs from the bolt 10 by the absence of mixing elements 28 and 30 and inclusion of an upper portion 216 having a modified mixing portion 222 with one or more mixing strands 224. The mixing strands 224 are attached at either end thereof to the cable 14 by crimped bands 226. The strands may be attached to the cable 14 via welding, adhesives or other attachments adjacent the anchored end 18 of the cable 14 and adjacent the resin compactor 52. The mixing strands 224 are spaced apart from each other (preferably equidistantly) and from the cable 14 and bird cages 24 so that when the cable bolt 210 is installed, resin may flow between the mixing strands 224 and the cable 14 and bird cages 24. The provision of mixing strands 224 improves the mixing of the resin during installation as well as increasing the bond strength of the resulting anchorage. The number of mixing strands 224 is selected to provide sufficient mixing of resin during installation and preferably is three. When at least two equispaced mixing strands 224 are used, the cable 14 is urged toward the center of the bore hole 12 resulting in a uniform annulus resin about the cable 14. The mixing strands 224 also help destroy the resin cartridge 90 to deter "gloving". "Gloving" may occur after a resin cartridge is ruptured when residual portions of a cable become positioned around portions of a cable. If this occurs, the residual portions of the resin cartridge surrounding the cable block the resin from flowing directly around and between the individual strands of the cable, hence preventing secure attachment of resin to the cable. The mixing strands 224 maintain any residual portion of the resin cartridge 90 spaced apart from the cable 14.

Returning to FIGS. 1–3, the cable bolt 10 is installed in a mine roof bore hole 12 as follows, with installation of the cable bolts 110 and 210 being similar thereto. The resin cartridge 90 preferably contains a hardenable resin and a catalyst in separate compartments (not shown) or other suitable grouting material and is inserted into the blind end of the drilled bore hole 12. The bearing plate 70 is placed adjacent the barrel and wedge assembly 64 and appropriate washers may also be included between the bearing plate 70 and the barrel and wedge assembly 64 as needed. The cable bolt 10 is inserted into the bore hole 12 with a conventional bolting machine such that the resin cartridge 90 ruptures and the resin and the catalyst are released. During insertion, the drivehead 60 is rotated by the bolting machine to mix the resin and catalyst components to form a mixed resin 92. The mixed resin 92 flows along the upper portion 16 of the cable 14 having the mixing portion 22 and is prevented from flowing further down the length of the cable 14 by the resin compactor 52. Because the shaft 72 is crimped or swaged to the cable 14 preventing relative axial movement between the cable 14 and the shaft 72, rotation of the drivehead 60 causes rotation of the cable 14 and shaft 72. The resin is mixed during rotation of the bolt 10 via the bird cages 24 mixing elements 28 and 30, bent portions 124 and/or mixing strands 224. As the shaft 72 rotates, the plug 82 threads down the shaft 72 thereby urging the expansion shell 80 radially outward into gripping engagement with the wall of the bore hole 12. As the expansion shell 80 engages with the bore hole wall, the lower portion 20 of the cable bolt 10 between the mechanical anchor 78 and the drivehead 60 is tensioned. Engagement of the expansion shell 80 with the wall of the bore hole 12 typically occurs before the mixed resin 92 has set. Thus, the lower portion 20 of the cable ago bolt 10 may be tensioned before the upper portion 16 of the cable bolt 10 is fixed via the mixed resin 92 to the rock strata.

The drivehead 60 may also serve as a torque tension indicator for the cable bolt 10. In operation, the drivehead 60 is mounted on the free end 62 of the cable resulting in an attachment between the drivehead 60 and the free end 62 of a predetermined strength. The drivehead 60 is rotated so that the expansion shell 80 engages the wall of the bore hole 12 and the lower portion 20 of the cable bolt 10 is tensioned. The drivehead 60 then is further rotated until the drivehead 60 fails or breaks off from the free end 62. The amount of torque required to be applied to the cable bolt 10 to cause the drivehead 60 to fail or break off is a function of the strength of the attachment between the drivehead 60 and the free end 62 of the cable 14. If desired, the free end 62 may be cut off the cable 14 below the barrel and wedge assembly 64.

It is important that the resin 92 is completely mixed before the expansion shell 80 is fully engaged with the bore hole wall. Once the expansion shell 80 is fully engaged with the bore hole wall, it can no longer rotate nor can the cable 14 be further rotated. Thus the resin 92 must be completely mixed by the time the expansion shell 80 fully engages the bore hole wall.

Therefore, it is important to maximize the number of rotations the cable 14 experiences prior to anchoring of the mechanical anchor 78.

This may be achieved via use of a further modified embodiment of a cable mine roof bolt 310 illustrated in FIGS. 11–14. The cable bolt 310 when installed, provides for sufficient rotations of the cable 14 to mix the resin 92 before the expansion shell 78 fully engages with the bore hole wall. The cable mine roof bolt 310 is substantially the same as the cable mine roof bolts 10, 110 and 210 disclosed above except that the cable mine roof bolt 310 includes a lower portion 320 having an insert 322 placed into the top of the plug 82, and a washer 324 and spring 326 interposed between the stop washer 84 and the expansion shell 80. The washer 324 provides a surface against which the spring 326 may bear.

The insert 322 is releasably engaged on the cable 14 above the shaft 72. The insert 322 may include exterior threads or have a smooth exterior surface which is threadable into the interior threads of the plug 82. The insert 322 delays advancement of the plug 82 along the shaft threads 76 into the expansion shell 80 during rotation of the cable mine roof bolt 310. The delay of the advancement of the plug 82 into the expansion shell 80 increases the number of rotations the cable mine roof bolt 310 experiences before the expansion shell 80 is fully engaged with the bore hole wall. During installation of the cable mine roof bolt 310, the insert 322 abuts against the threaded end of the shaft 72. As the plug 82 advances down the shaft 72, the insert 322 will eventually be forced out of engagement with the plug 82.

The spring 326 with the washer 324 bias the expansion shell against the plug 82 to ensure initial engagement of expansion shell 80 with the bore hole wall during installation to prevent free spinning of the mechanical anchor 78 within the bore hole during installation. The spring 326 should have appropriate tension to advance the expansion shell 80 to the desired extent according to the specific bore hole dimensions. Additionally, as the expansion shell 80 advances down the shaft 72, the tension exerted by the spring accordingly increases further slowing the advancement of the plug 82 relative to the expansion shell 80 and increasing the possible number of rotations experienced by the cable bolt 310 during installation.

Figure 13:
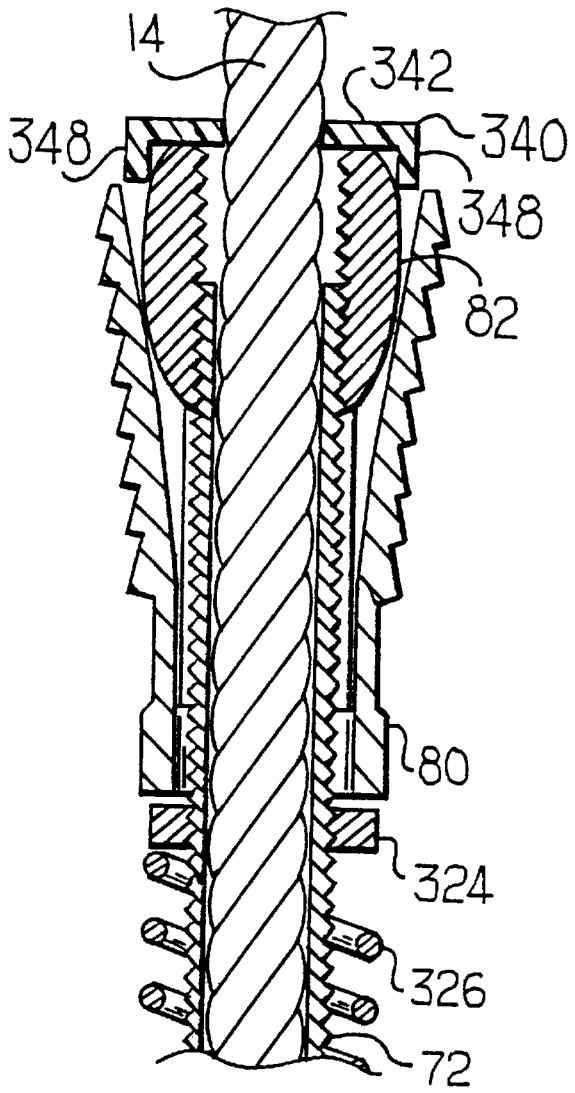
FIG. 13 is a cross section view of a delay cap and plug assembly which may be used with the modified cable mine roof bolt depicted in FIG. 12.
Figure 14:
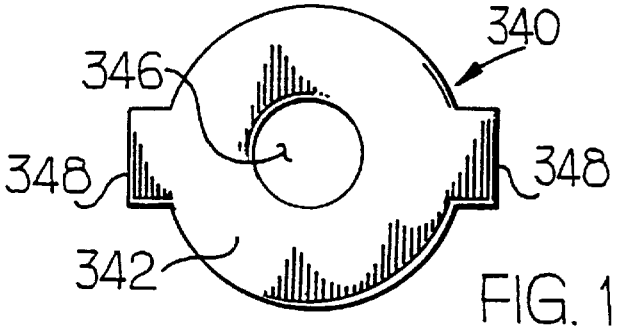
FIG. 14 is a plan view of the delay cap depicted in FIG. 13.

As an alternative to the insert 322, the cable roof bolt 310 may include a delay cap 340 depicted in FIGS. 13 and 14. The delay cap 340 includes a washer portion 342 which defines an aperture 346 and at least two lugs 348 extending therefrom. The cable 14 extends through the aperture 346 in a tight frictional fit. As shown in FIG. 13, the lugs 348 may be deformed downward to surround the plug 82 and may be pressed against the exterior surfaces of the plug 82. The tight frictional fit of the delay cap 340 on the cable 14 delays the advancement of the plug 82 onto the shaft 72. During installation of the cable mine roof bolt 310, the delay cap 340 abuts against the upper end of the plug 82 and the threaded end of the shaft 72.

As the plug 82 advances down the shaft 72, the delay cap 324 is eventually forced out of engagement with the plug 82.

The modifications of mine roof cable bolts 10, 110 and 210 and the features of mine roof cable bolt 310 may be used in various combinations to maximize resin mixing and to increase the number of rotations experienced by the bolt before the expansion shell 80 fully engages the bore hole wall. If the expansion shell 80 is prematurely fully engaged with the bore hole wall, the resin will not be properly mixed and will not properly set up, providing reduced holding capacity to the cable mine roof bolt.

The tensionable cable bolt of the present invention offers several distinct advantages over the tensionable bolts of the prior art. The cable bolt is substantially easier to fit into a bore hole than the elongated rods of the prior art systems. The cable bolt is additionally lighter and easier to transport. The cable exhibits greater resin mixing and bonding capabilities by provision of bird cages, bent portions, and/or mixing elements. Furthermore, due to the flexibility of the cable, the cable bolt can be easily adjusted to bore holes of any lengths regardless of the space limitations in a mine. The strength capacity of cables exceeds conventional rebar and, therefore, cable is the preferred reinforcement for certain roof conditions.

Conventionally, the installation of resin grouted cable bolts requires three steps: (1) mixing the resin; (2) allowing the resin to set over a period of several minutes; and (3) tensioning the cable. The present invention allows these steps to be accomplished simultaneously. Because the expansion shell spreads upon installation and rotation of the cable bolt, the cable bolt is tensioned during installation and mixing of the resin. The conventional hold cycle previously used to allow the resin to cure before a bolt is tensioned is avoided. Furthermore, the mixing assembly and resin grouting together provide a primary anchorage for the cable bolt and the expansion anchor provides a secondary anchorage of the cable bolt.

The cable bolt of the present invention may be used for primary support of a mine roof because it can be tensioned and can be installed by conventional mining machines. The correlation of the torque tension required to break the drivehead away from the cable with the attachment strength between the drivehead and the cable allows a predetermined load to be accurately applied to tension the cable bolt.

Although the present invention has been described in detail in connection with the discussed embodiments, various modifications may be made by one of ordinary skill in the art without departing from the spirit and scope of the present invention. Therefore, the scope of the present invention should be determined by the attached claims.

What is claimed is:

1. A tensionable cable mine roof bolt comprising:

a multi-strand cable having a first end, a second end and a mixing portion positioned between said first and second ends;

a barrel and wedge assembly attached to said cable between said first end and said mixing portion and adapted to support a bearing plate;

a drivehead attached to said cable first end;

an externally threaded shaft surrounding and attached to said cable between said barrel and wedge assembly and said mixing portion; and a mechanical anchor threaded onto an end of said shaft distal from said barrel and wedge assembly.

2. The tensionable cable mine roof bolt as claimed in claim 1 wherein said cable includes a central strand and a plurality of outer strands wrapped around each other and said central strands, wherein said mixing portion comprises a plurality of nuts received on said central strand at spaced apart locations.

3. The tensionable cable mine roof bolt as claimed in claim 1 wherein said mixing portion further comprises a sleeve member surrounding said cable, said sleeve member having a plurality of baffles mounted on an exterior surface of said sleeve member.

4. The tensionable cable mine roof bolt as claimed in claim 3 wherein said mixing portion further comprises a pair of said sleeve members wherein each said baffle mounted on each said sleeve member is adapted to change a direction of resin flowing past said baffles.

5. The tensionable cable mine roof bolt as claimed in claim 1 wherein said mixing portion comprises a bent section of said cable.

6. The tensionable cable mine roof bolt as claimed in claim 5 wherein said mixing portion comprises a plurality of said bent sections.

7. The tensionable cable mine roof bolt as claimed in claim 1 wherein said mixing portion comprises a mixing wire fixed at one end thereof to said cable second end and fixed at another end thereof to said cable at a location intermediate said cable first and second ends.

8. The tensionable cable mine roof bolt as claimed in claim 7 further comprising a plurality of said mixing wires.

9. The tensionable cable mine roof bolt as claimed in claim 1 further comprising a mechanical anchor delay member surrounding said cable, wherein when said bolt is rotated, said delay member delays a rate at which said mechanical anchor expands to engage a bore hole wall.

10. The tensionable cable mine roof bolt as claimed in claim 9 wherein said delay member comprises a spring surrounding said shaft, said spring adapted to urge said mechanical anchor towards said cable second end.

11. The tensionable cable mine roof bolt as claimed in claim 9 wherein said delay member comprises an insert received within an annulus between said mechanical anchor and said cable.

12. The tensionable cable mine roof bolt as claimed in claim 9 wherein said delay member comprises a cap mounted on an end of said mechanical anchor, wherein said cap defines a hole through which said cable extends, said cable being in frictional engagement with said cap.

13. A tensionable cable mine roof bolt for insertion into a bore hole in rock and adapted to be resin grouted, said bolt comprising:

a bearing plate;

a barrel and wedge assembly supporting said bearing plate;

a multi-strand cable having a first end attached to said barrel and wedge assembly and having a resin mixing portion positioned on said cable distal from said first end;

a drivehead releasably mounted on said first end opposite said barrel and wedge assembly from said bearing plate;

an externally threaded shaft mounted on said cable between said bearing plate and said resin mixing assembly; and a mechanical anchor threaded onto said shaft, wherein when said bolt is rotated within the bore hole to mix the resin, said mechanical anchor engages the rock and tensions said bolt.

14. The tensionable cable mine roof bolt as claimed in claim 13 wherein said cable includes a central strand and a plurality of outer strands wrapped around each other and said central strand, wherein said resin mixing portion comprises a plurality of nuts received on said central strand at spaced apart locations.

15. The tensionable cable mine roof bolt as claimed in claim 13 wherein said mixing portion comprises a sleeve member surrounding said cable, said sleeve member having a plurality of baffles mounted on an exterior surface of said sleeve member.

16. A tensionable cable mine roof bolt as claimed in claim 17 wherein said mixing portion further comprises a pair of said sleeve members wherein each said baffle mounted on each said sleeve member is adapted to change a direction of resin flowing past said baffles.

17. The tensionable cable mine roof bolt as claimed in claim 13 wherein said resin mixing portion comprises a bent section of said cable.

18. The tensionable cable mine roof bolt as claimed in claim 15 wherein said resin mixing portion comprises a plurality of said bent sections.

* * * * *